US006505745B1

(12) United States Patent
Anderson

(10) Patent No.: US 6,505,745 B1
(45) Date of Patent: Jan. 14, 2003

(54) HOLDER FOR ARTICLES SUCH AS NAPKINS

(76) Inventor: Richard E Anderson, 21 Hackmore La., Canoga Park, CA (US) 91307

( * ) Notice: Subject to any disclaimer, the term of this patent is extended or adjusted under 35 U.S.C. 154(b) by 0 days.

(21) Appl. No.: 09/629,334

(22) Filed: Aug. 1, 2000

(51) Int. Cl.[7] ..... A47F 7/00
(52) U.S. Cl. ..... 211/51; 211/181.1; D7/631
(58) Field of Search ..... 211/51, 50, 181.1; D7/631

(56) References Cited

U.S. PATENT DOCUMENTS

D204,294 S * 4/1966 Kennedy
3,473,672 A * 10/1969 Fincher ..... 211/51
D234,999 S * 4/1975 Stewart ..... D7/631
3,966,103 A * 6/1976 Abrams ..... 211/51 X
4,298,126 A * 11/1981 Filipowicz ..... 211/50
D304,660 S * 11/1989 Lynch ..... D7/631
D334,854 S * 4/1993 Pestone
D373,516 S * 9/1996 Curcio ..... D7/631
D395,798 S * 7/1998 Goodman ..... D7/631
D433,286 S * 11/2000 Goodman et al. ..... D7/631

* cited by examiner

*Primary Examiner*—Robert W. Gibson, Jr.
(74) *Attorney, Agent, or Firm*—Anderson Kill & Olick, PC

(57) ABSTRACT

The present invention relates to an article holder for retaining stacked articles dispensed in a horizontal plane and held in place by a retaining member. The retaining member is adjustable for the height of the stack of the horizontally disposed articles and is adapted to be removed as a retaining member or placed beneath the stacked articles if desired.

8 Claims, 1 Drawing Sheet

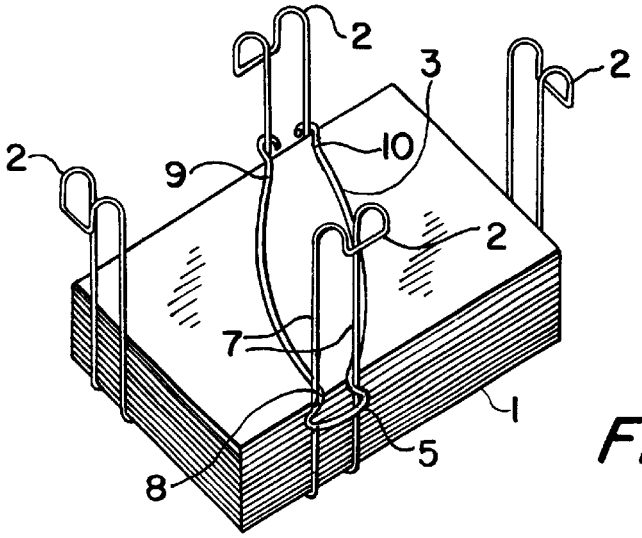
FIG.1
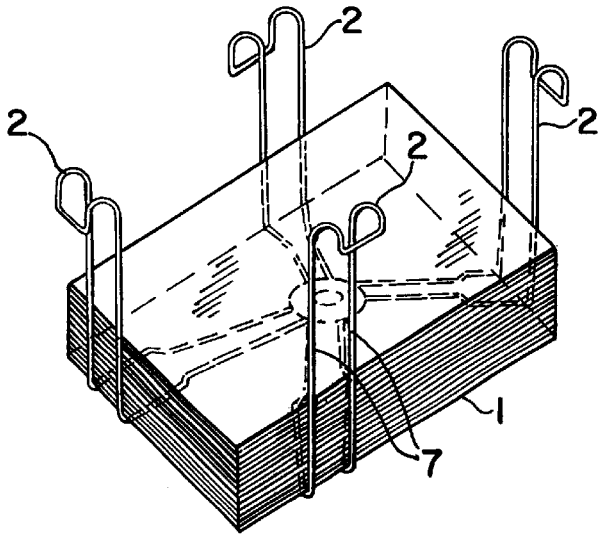
FIG.2
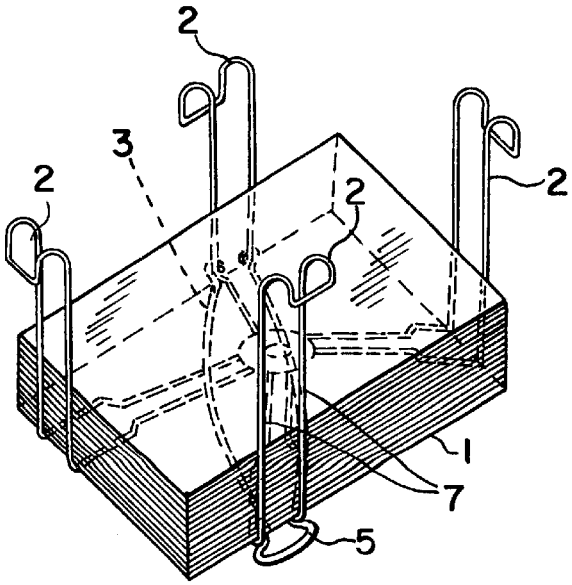

HOLDER FOR ARTICLES SUCH AS NAPKINS

BACKGROUND OF THE INVENTION

1. Field of the Invention

The present invention relates to a container for articles such as napkins. In particular, the present invention relates to an article holder for retaining stacked articles dispensed in a horizontal plane and held in place by a retaining member which is adjustable for the height of the stack of the horizontally disposed articles and which is adapted to be removed as a retaining member or placed beneath the stacked articles if desired.

2. The Prior Art

Various types of article holders, particularly napkin holders, are known in the art.

One common type of napkin holder, as used in restaurants and commercial establishments, to hold a stack of folded napkins, is formed with either two or three side walls and has dispensing openings on either one side or two opposite sides.

Another type of napkin holder as used in the past includes a base, and wire form retaining members extended upwardly from the sides of the base.

The above two types of napkin holder have certain disadvantages. While the former can prevent napkins from being blown away, the stored napkins are not easily retrieved because its openings are limited. The latter type would not prevent the stored napkins from being easily blown during windy weather or by an electric fan. Most napkins are approximately 6½"×6½" and are easily blown away. None of the known napkin holders can simultaneously prevent napkins from being blown away and also provide easy access to the napkins.

SUMMARY OF THE INVENTION

It is therefore a principal object of the present invention to provide an article holder having a retaining or anchoring member for holding articles such as napkins horizontally stacked with respect to the article holder.

It is still a further object of the present invention to provide a retaining member for an article held which is adapted to be raised or lowered for different heights for the height of the stored napkins or articles and which can be placed underneath the napkins or articles.

It is yet another object to provide an article holder which is a simple and effective design and is portable.

Other objects of the present invention will become apparent from the foregoing description and drawings in which:

BRIEF DESCRIPTION OF THE DRAWINGS

FIG. 1 is a perspective view of a napkin holder in accordance with this invention retaining a stack of napkins in a windy condition.

FIG. 2 is a perspective view of a napkin holder in accordance with this invention being used in a location where the wind is not a consideration.

DETAILED DESCRIPTION OF THE PREFERRED EMBODIMENTS

Referring now to the drawings, FIG. 1 is a perspective view of the present invention showing an article holder such as a napkin holder formed of a base 1 having a horizontal surface on which articles such as napkins can be stacked horizontally disposed parallel to the surface of the base 1. The article holder 1 includes at least one pair of longitudinally extending side members 2.

In FIG. 1 two pairs of longitudinally extending side members 2 are preferably shown. It is understood, however, that the number of pairs of longitudinally extending side members 2 may vary and the present invention is not limited to any number of pairs of side members 2. The bottom portion of each side member 2 is preferably welded or else otherwise connected to the base 1 of the article holder.

The article holder further includes a retaining or anchoring member 3 which is horizontally disposed in its retaining or anchoring position substantially parallel to the surface of the surface of the base 1 of the article holder. The retaining member is of sufficient length to extendingly engage each of the opposing side retaining members as shown in FIG. 1.

FIG. 1 provides a perspective view of a napkin holder in this invention retaining a stack of napkins in a windy condition. A substantially horizontal retaining member 3 which is extended through a pair of opposite sides of retaining members 2. It can be seen that the horizontal retaining member 3 can freely slide up and down along the pair of side retaining members. The ends of the horizontal retaining member can be either a ring or a T-shape connected with the side retaining member 2.

The substantially horizontal retaining member, for example, a wire form or a bar, which serves as a weight to hold the napkins in place, can prevent the napkins from being blown away due to wind. Meanwhile, the customer can easily pick up napkins from various directions. After a stack of napkins is run out, a new stack of napkins can be placed easily by lifting the horizontal retaining member 3. The holder can be made of any height but preferably 6½" high to permit it to contain a 6" stack of napkins.

FIG. 2 is a perspective view of a napkin holder in this invention being used in a conventional way. When there is no wind, the horizontal retaining member is positioned on the base. The stack of napkins is on top of it. In this case, the napkin holder simply becomes a conventional one, and the customers are more free to pick up napkins without any encumbrances.

The side retaining member 2 can be made of metal or plastic. The horizontal retaining member 3 can be a wire, a solid strip, or the like, as long as it can be employed to retain the napkins against the movement by wind. The top section of the retaining member 2 is formed in a curve shape, to prevent the customers from encountering a sharp edge.

The side retaining members 2 can be formed of a wire having a closed curved end and two separate bars at the other end. The loops and curves in the wire can be bent into any desired shape by the manufacturer. The horizontal retaining member 3 or cross bar that holds down member 3 can have a roundish center or a roughly square shape.

The horizontal retaining member 3 is preferably shaped of a metal material formed within a closed end at one end having a neck 8 with a width narrower than the width between the two bars 7 of the side retaining member 2 through which the neck 8 protrudes. The closed end 5 is wider than the width between the two bars of the side retaining member 2 preventing the closed end from being pulled through the side retaining member 2 when the horizontal retaining member 3 is in its horizontally disposed position. The horizontal retaining member 3 has another end formed of two separate pieces 9, 10, each piece has a loop encircling one of the bars of a side retaining member 2. By encircling each bar the horizontal retaining member 3 can be raised or lowered horizontally along the length of the side bars of the retaining member 2. In addition the horizontal retaining member 2 can be rotated for the horizontal retaining member 3 to be removed from the side member from engagement within the two bars of the side retaining member 3.

While the above description has illustrated the invention as a napkin holder, it is contemplated that it can be used to hold stacks of different materials, such as food trays, cup lids, paper plates, towels, sheet materials, and the like.

Similarly, while the base is shown as rectangular it can be circular, oval or any other designed shape and can include any member of side retaining members.

The napkin holder can be made of any material of choice by the manufacturer, such as brass and copper or chrome-plated steel.

In view of the foregoing, it can be seen that the improved napkin holder can be provided by placing a holding member on a stack of napkins when there is a wind in order to retain the napkins in place and prevent them from being blown away by the wind and putting the holding member down below the stack of napkins when there is no wind and thus there is no need to securely hold the napkins in place by other means.

While particular embodiments of the present invention have been shown and described, it will be obvious to those skilled in the art that changes and modifications may be made without departing from the inventions in its broader aspects and, therefore, the aim in the appended claims is to cover all such changes and modifications as fall within the true spirit and scope of this invention.

What is claimed is:

1. An article holder for holding a stack of articles, comprising:

a base to support said stack of articles;

at least one pair of side retaining members connected to sides of said base and extending upwardly from the base; and a holding member having two ends and retaining said stack of articles against movement with respect to said base;

wherein one end of said holding member is pivotably connected to one of said at least one pair of side retaining members and another end of said holding member is extended through said other one of said at least one pair of side retaining members for restraining said stack of articles and can be disengaged therefrom.

2. The article holder according to claim 1 further comprising:

said side retaining members each having two bars, said holding member having two ends, one end being formed of two separate strips, each strip terminating in a closed loop encircling a respective one of said two bars of one of said side retaining members, so that said holding member can be raised and lowered along a longitudinal length of said one of said side retaining members;

said holding member having a second end formed to have a narrow neck at said end and terminating in a loop at said end, said looped end being wider than said neck so that the said neck is adapted to extend between said two bars of another one of said side retaining member and to be rotated so that said second end can engage or disengage from said another one of said side retaining member.

3. The article holder of claim 1 wherein said side retaining members are formed of wire material.

4. The article holder of claim 2 wherein said holding member is formed as a wire.

5. The article holder of claim 1 wherein said base is a rectangular shape.

6. The article holder of claim 1 wherein said articles are napkins, food trays, cup lids or sheet materials.

7. A napkin holder comprising:

a base on which said napkins are placed;

two pairs of side retaining members retaining said napkins within said base;

a substantially horizontal retaining member having two ends and disposed on said napkins; and wherein said substantially horizontal retaining member is pivotably connected to one of said two pairs of side retaining members, said substantially horizontally retaining member being disengageable from and being slidingly moved up and down along another one of said two pair of side retaining members for holding said napkins on said base.

8. The napkin holder of claim 7 wherein said substantially horizontal retaining member has a wire form.

* * * * *